US005134019A

United States Patent [19]

Shiokawa et al.

[11] Patent Number: 5,134,019

[45] Date of Patent: Jul. 28, 1992

[54] THERMAL IMAGE TRANSFER RECORDING MEDIUM

[75] Inventors: Keiichi Shiokawa, Numazu; Youji Ide, Mishima, both of Japan

[73] Assignee: Ricoh Company, Ltd., Tokyo, Japan

[21] Appl. No.: 510,848

[22] Filed: Apr. 18, 1990

[30] Foreign Application Priority Data

Apr. 26, 1989 [JP] Japan ..... 1-104693
Mar. 28, 1990 [JP] Japan ..... 2-77097

[51] Int. Cl.[5] ..... B41M 5/26

[52] U.S. Cl. ..... 428/212; 428/195; 428/214; 428/216; 428/321.3; 428/336; 428/412; 428/414; 428/447; 428/473.5; 428/474.4; 428/475.5; 428/480; 428/484; 428/488.1; 428/488.4; 428/500; 428/522; 428/537.5; 428/913; 428/914

[58] Field of Search ..... 428/195, 212, 318.4, 428/321.3, 913, 914, 213–216, 336, 412–414, 447, 473.5, 474.4, 475.5, 480, 484, 488.1, 488.4, 500, 522, 537.5

[56] References Cited

U.S. PATENT DOCUMENTS 5,024,887 6/1991 Yamane ..... 428/419

*Primary Examiner*—Pamela R. Schwartz
*Attorney, Agent, or Firm*—Oblon, Spivak, McClelland, Maier & Neustadt

[57] ABSTRACT

A thermal image transfer recording medium comprising a support, and an ink layer formed thereon, consisting essentially of (i) a lower non-porous layer portion located in the vicinity of the support, comprising a first thermofusible ink and a first resin, and (ii) an upper porous layer portion located on top of the lower layer portion, comprising a second thermofusible ink and a second resin having a minute porous structure in which the second thermofusible ink is supported. In this recording medium, the occupation ratio of the second resin in the upper porous layer portion is higher than that of the first resin in the lower layer portion, and the second resin and the support is connected with each other by the first resin.

25 Claims, 2 Drawing Sheets

THERMAL IMAGE TRANSFER RECORDING MEDIUM

BACKGROUND OF THE INVENTION

1. Field of the Invention

This invention relates to a thermal image transfer recording medium which can yield images with high density and hardly causes decrease in the density even when it is used repeatedly, and to a production process thereof.

2. Discussion of Background

Recording apparatus, such as a printer and a facsimile apparatus, to which the thermal image transfer recording method is applied are now widespread. This is because the recording apparatus of this type are relatively small in size and can be produced inexpensively, and their maintenance is simple.

In the conventional thermal image transfer recording medium for use with the thermal image transfer recording apparatus, a single ink layer is merely formed on a support. When such a recording medium is used for printing images, those portions of the ink layer heated by a thermal head completely transfer to an image receiving sheet at only one-time printing. Therefore, the recording medium can be used only once, and can never be used repeatedly. The conventional recording medium is thus disadvantageous from the economical point of view.

In order to overcome the above drawback in the prior art, there have been proposed the following methods:

(1) A microporous ink layer is formed on a support so that a thermofusible ink impregnated in the ink layer can gradually ooze out as disclosed in Japanese Laid-Open Patent Applications 54-68253 and 55-105579;

(2) A porous layer is provided on an ink layer formed on a support so that the amount of an ink which oozes out from the ink layer can be controlled as disclosed in Japanese Laid-Open Patent Application 58-212993; and (3) An adhesive layer is interposed between an ink layer and a support so that the ink layer can be gradually exfoliated from the support when images are printed as disclosed in Japanese Laid-Open Patent Applications 60-127191 and 60-127192.

However, the above three methods have shortcomings as described below.

When the above method (1) is employed, the ink cannot sufficiently ooze out after the repeated use of the recording medium. As a result, the density of printed images gradually decreases as the number of printing times increases.

Regarding the method (2), the mechanical strength of the porous layer is decreased when the size of the pore included therein is increased in order to increase the image density, and thus the ink layer is to peel off the support together with the porous layer.

As for the method [3), the amount of the ink layer which peels off the support cannot be controlled uniformly when images are printed.

Furthermore, most of the conventional methods have been developed for a serial thermal head for use in a recording apparatus such as a word processor. Therefore, when those methods are applied to a line thermal head for use in a recording apparatus such as a facsimile apparatus or a bar code printer, some troubles are brought about, for instance exfoliation of an ink layer, and decrease in image density when the recording medium is used repeatedly.

In addition to the above, in a thermofusible ink which is prepared by a conventional method and contained in an ink layer, its dispersed system is destroyed when a thermal energy is repeatedly applied to the ink layer by a thermal head. As a result, the optical density of the ink contained in the ink layer is decreased before the ink layer is transferred to an image receiving sheet. Therefore, the density of images transferred from such an ink layer is not sufficiently high for use in practice.

Under these circumstances, there has been greatly expected a thermal image transfer recording medium for use with a line thermal head, which can yield images with high image density and hardly causes decrease in the image density even when it is used repeatedly.

SUMMARY OF THE INVENTION

Accordingly, a first object of this invention is to provide a thermal image transfer recording medium which can yield images with high density and hardly causes decrease in the image density even when it is used repeatedly, and, in particular, a thermal image transfer recording medium which is free from peeling off or complete transfer of an ink layer heated by a thermal head to an image receiving sheet and can yield high quality images even when it is repeatedly used with a line thermal head.

A second object of the present invention is to provide a production process of the above-described thermal image transfer recording medium.

The first object can be attained by a thermal image transfer recording medium comprising a support, and an ink layer formed thereon, consisting essentially of (i) a lower non-porous layer portion located in the vicinity of the support, comprising a first thermofusible ink and a first resin, and (ii) an upper porous layer portion located on top of the lower non-porous layer portion, comprising a second thermofusible ink and a second resin having a minute porous structure in which the second thermofusible ink is supported, the relative amount of the second resin in the upper porous layer portion being higher than that of the first resin in the lower non-porous layer portion, and the second resin and the support being connected with each other by the first resin.

The second object can be attained by a production process comprising the steps of (1) forming the lower non-porous layer portion by coating a first mixture of the first resin and the first thermofusible ink which has been gelled in advance onto the surface of the support, and drying the first mixture coated; and (2) forming the upper porous layer portion by coating a second mixture of the second resin and the second thermofusible ink onto the surface of the lower non-porous layer portion.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

The thermal image transfer recording medium according to the present invention comprises in its ink layer a lower non-porous layer portion located in the vicinity of a support, comprising a first thermofusible ink and a first resin, and an upper porous layer portion located on top of the lower layer portion, comprising a second thermofusible ink and a second resin having a minute porous structure in which the second thermofusible ink is supported.

In this recording medium, the relative amount of the second resin in the upper porous layer portion is higher than that of the first resin in the lower layer portion, and the second resin and the support are connected with each other by the first resin. The second resin contained in the upper porous layer portion is three-dimensionally extended to form a porous structure.

Since the recoding medium of the present invention has the above structure, high quality images can be constantly obtained even when the recording medium is used repeatedly.

Namely, a large amount of thermofusible ink can be stored in the lower non-porous layer portion, and this ink is continuously supplied to the upper porous layer portion when images are printed repeatedly. Thus, the initial ink concentration at the surface of the ink layer can be maintained constant even when the recording medium is used repeatedly.

Furthermore, since the resin contained in the lower layer portion connects the resin contained in the upper layer portion with the support, it prevents a heated portion of the ink layer to completely peel off the support when images are printed only once. Therefore, the recording medium can be used repeatedly.

In addition, the upper layer portion has a porous structure in which a thermofusible ink is supported, so that the amount of the ink which is transferred to an image receiving sheet can be well controlled.

Referring now to the accompanying drawings, the present invention will be explained in detail.

Figure 1:
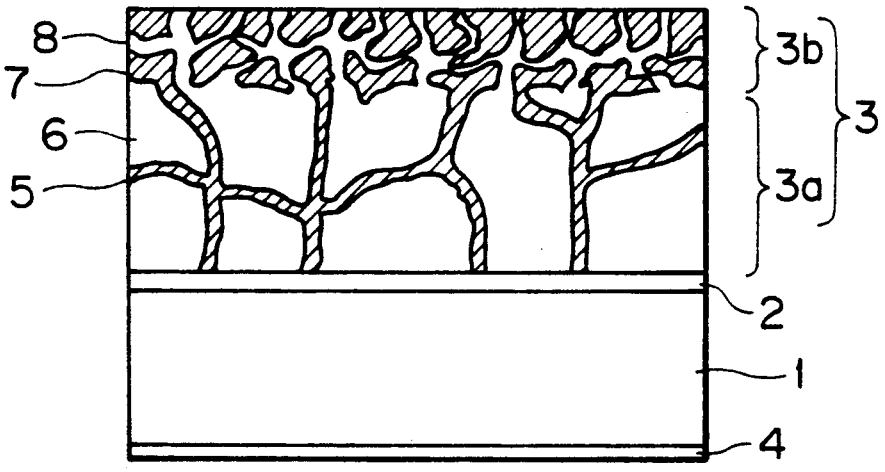
FIG. 1 is a schematic cross-sectional view of a thermal image transfer recording medium according to the present invention.

FIG. 1 is a cross-sectional view of a thermal image transfer recording medium according to the present invention. In this figure, reference numeral 1 denotes a support, reference numeral 3 denotes an ink layer, reference numeral 3*a* denotes a lower non-porous layer portion, reference numeral 3*b* denotes an upper porous layer portion, reference numeral 5 denotes a first resin, reference numeral 7 denotes a second resin, reference numeral 6 denotes a first thermofusible ink, and reference numeral 8 denotes a second thermofusible ink.

In addition to the above basic structure, the support 1 may be provided with a heat-resistant protective layer 4 on its back surface as shown in FIG. 1. Moreover, an adhesive layer 2 may also be interposed between the support 1 and the ink layer 3, if necessary.

The relative amount of the second resin 7 in the upper porous layer portion 3*b* is higher than that of the first resin 5 in the lower non-porous layer portion 3*a*, and, as shown in FIG. 1, the second resin 7 is connected with the support 1 by the first resin 5.

Figure 2:
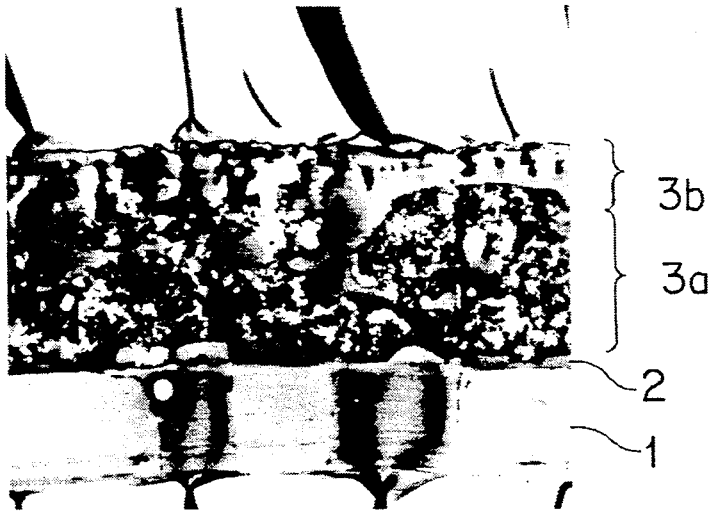
FIG. 2 is an electron micrograph, taken by a transmission electron microscope (TEM), showing a cross section of the thermal image transfer recording medium according to the present invention prepared in Example 3.

FIG. 2 is an electron micrograph of 2200 magnifications showing a cross section of the thermal image transfer recording medium prepared in Example 3. In this figure, reference numerals 1, 2, 3*a* and 3*b* denote a support, an adhesive layer, a lower non-porous layer portion and an upper porous layer portion, respectively. In the lower and upper layer portions shown in this photo, dark portions indicate the thermofusible ink, and gray portions indicate the resin.

It is preferable that the relative amount of the second resin in the upper porous layer portion be 30 to 70 wt.%, more preferably 40 to 60 wt.%, of the total weight of the upper porous layer portion, and that of the first resin in the lower layer portion be 20 to 40 wt.% of the total weight of the lower layer portion.

The first resin and the second resin contained in the lower non-porous layer portion and the upper porous layer portion, respectively, may be the same or different, if compatible with each other.

The first thermofusible ink contained in the lower layer portion and the second thermofusible ink supported in the porous structure of the upper layer portion may also be the same or different, if compatible with each other.

The first and second thermofusible inks respectively comprise a coloring agent and a vehicle.

The coloring agent can be selected from conventionally known pigments and dyes. Of the known pigments, carbon black and phthalocyanine pigments are preferably used. Among the known dyes, direct dyes, acid dyes, dispersible dyes and oil-soluble dyes are preferably used.

Examples of the vehicles include natural waxes such as beeswax, carnauba wax, whale wax, Japan wax, candelilla wax, rice bran wax and montan wax, paraffin wax, microcrystalline wax, oxidized wax, ozocerite, ceresine wax, ester wax, higher fatty acids such as margaric acid, lauric acid, myristic acid, palmitic acid, stearic acid, fromic acid and behenic acid, higher alcohols such as stearyl alcohol and behenyl alcohol, esters such as sorbitan fatty acid ester, and amides such as stearic amide and oleic amide.

Resins having a glass transition temperature higher than the melting point of the first thermofusible ink can be used as the first resin to be contained in the lower non-porous layer portion; and resins having a glass transition temperature higher than the melting point of the second thermofusible ink can be used as the second resin to be contained in the upper porous layer portion.

Examples of such resins include a vinyl chloride resin, a copolymer of vinyl chloride and vinyl acetate, a polyester resin, an epoxy resin, a polycarbonate resin, a phenol resin, a polyimide resin, a cellulose resin, a polyamide resin and an acrylic resin.

It is necessary that the second thermofusible ink is gelled when mixed with the second resin, or is non-compatible with second resin in order to obtain a porous upper layer.

The thickness of the lower non-porous layer portion is preferably 3 to 15 μm, although it can be determined depending upon how many times the recording medium is supposed to be subjected to image printing. The thickness of the upper porous layer portion is preferably 1 to 5 μm.

It is preferable that the diameter of the minute pore included in the porous structure of the upper layer portion be 1 to 12 μm, and its average value be 4 to 8 μm.

Conventionally known heat-resistant materials can be used as the support of the present invention. Examples of such materials include a film of plastics such as polyester, polycarbonate, triacetyl cellulose, nylon and polyimide, and a sheet of cellophane, parchment paper or condenser paper.

The preferred thickness of the support is 2 to 15 μm from viewpoints of thermal sensitivity and mechanical strength.

It is possible to improve the heat resistance of the recording medium by providing, as shown in FIG. 1, a heat-resistant protective layer 4 on the back side of the support 1, which side is brought into contact with a thermal head. The heat-resistant protective layer 4 can be formed by using a silicone resin, a fluorine-contained resin, a polyimide resin, an epoxy resin, a phenol resin, a melamine resin or nitrocellulose.

As shown in FIG. 1, an adhesive layer 2 may also be interposed between the support 1 and the ink layer 3, if necessary. By this adhesive layer, the ink layer 3 can be firmly fixed on the support 1.

Examples of materials for the adhesive layer include a copolymer of ethylene and vinyl acetate, a copolymer of vinyl chloride and vinyl acetate, a copolymer of ethylene and acrylate, polyethylene, polyamide, polyester, a petroleum resin and nylon. These materials can be used either singly or in combination.

The thickness of the adhesive layer is preferably 0.2 to 2.0 μm from the view points of adhesiveness and thermal sensitivity.

The thermal image transfer recording medium according to the present invention can be prepared by the following preparation process:

A first mixture of a first resin and a first thermofusible ink which has been gelled in advance is coated onto the surface of the support, and then dried to form a lower non-porous layer portion. Then a second mixture of a second resin and a second thermofusible ink is coated onto the lower non-porous layer portion, and then dried to form an upper porous layer portion. Thus, the thermal image transfer recording medium of the present invention can be obtained.

If necessary, after forming both the lower non-porous layer portion and the upper porous layer portion, they may be heated to a temperature near the softening point of the first resin to connect the second resin contained in the upper porous layer portion with the support 1 by the first resin contained in the lower layer portion.

As mentioned previously, it is required that the first resin contained in the first mixture and the second resin contained in the second mixture be the same or different, if compatible with each other, and the first themofusible ink and the second thermofusible ink be the same or different, if compatible with each other. It is also required that the second thermofusible ink be gelled when mixed with the second resin, or be non-compatible with the second resin.

The first thermofusible ink is gelled by a solvent dispersing method, a hot-melt dispersing method, or a method using a gelation agent.

In the case of the solvent dispersing method, the first thermofusible ink is dispersed in a proper solvent at a high temperature, followed by cooling the dispersion to room temperature. It is preferable to disperse the first thermofusible ink at a temperature between 25° to 40° C. when gelling effect and safety in operation are taken into consideration.

The first thermofusible ink can also be gelled by using a gelation agent such as a glycerol fatty acid ester. The amount of the gelation agent to be added is preferably 5 to 50 wt.% of the total weight of the first thermosufible ink.

When the hot-melt dispersing method is employed, the components of the first thermofusible ink, that is, the coloring agent and the vehicle are admixed at an elevated temperature by using a roll mill, a sand mill or an attritor. Of these, a sand mill is preferred because the most homogeneous first thermofusible ink can be obtained by it. After admixing the coloring agent and the vehicle, the mixture is dispersed for a predetermined hour in a vessel heated to a temperature 10° to 20° C. higher than the melting point of the vehicle under application of high shear. To this dispersion, a solvent is further added as a diluent, and the mixture is dispersed again at a temperature between 25° and 35° C. The resulting dispersion is cooled to room temperature, thereby obtaining a gelled first thermofusible ink.

In order to obtain the desired ink layer, it is preferable to incorporate a blowing agent into the first mixture and/or second mixture. The blowing agent expands when the coated mixture is dried with application of heat, so that the configuration or distribution of the first resin in the lower layer portion becomes homogeneous, and the upper layer portion can have a uniform porous structure.

Examples of the blowing agents preferably used in the present invention include azo compounds such as azodicarbonic amide, azobisisobutyronitrile, azocyclohexyl nitrile, diazoaminobenzene and barium diazocarboxylate.

The amount of the blowing agent is not specifically limited. However, the preferred amount of the blowing agent is 1 to 20 wt.%, more preferably 2 to 10 wt.%, of the total weight of the layer to be formed.

In order to control the expansion temperature and the expansion efficiency, a blowing accelerating agent such as zinc oxide, a stearate or a palmitate, or a plasticizer such as dioctyl phthalate may be further added, if necessary.

Instead of using such blowing agents, the desired ink layer can also be formed by using a mixed solvent of a solvent having high volatility and a solvent having low volatility. Namely, the lower non-porous layer portion can be formed by using the first mixture which is prepared by dissolving the first resin and the gelled first thermofusible ink into the mixed solvent; and the upper porous layer portion can be formed by using the second mixture which is prepared by dissolving the second resin and the second thermofusible ink into the mixed solvent.

Other features of this invention will become apparent in the course of the following description of exemplary embodiments, which are given for illustration of the invention and are not intended to be limiting thereof.

EXAMPLE 1

Preparation of Support

One surface of a polyethylene terephthalate film having a thickness of 4.5 μm was coated with a silicone resin, thereby obtaining a support provided with a heat-resistant protective layer.

Preparation of Gelled First Thermofusible Ink

Fifteen parts by weight of carbon black, 60 parts by weight of candelllla wax and 25 parts by weight of polyethylene oxide wax were placed in a sand mill vessel, and dispersed at an elevated temperature of 110° C.

to obtain a homogeneous ink dispersion. The resulting ink dispersion was cooled to room temperature, whereby a gelled first thermofusible ink was obtained.

Formation of Lower Non-Porous Layer Portion

A first mixture for forming a lower non-porous layer portion was prepared by dispersing 100 parts by weight of the gelled first thermofusible ink, 20 parts by weight of a copolymer of vinyl chloride and vinyl acetate and 20 parts by weight of azobisisobutyronitrile in 85 parts by weight of a 1:2 (weight basis) mixed solvent of toluene and methyl ethyl ketone.

The first mixture was coated onto the surface of the above-prepared support, and then dried at 80° C. for 1 minute to form a lower non-porous layer portion having a thickness of 10 μm.

Formation of Upper Porous Layer Portion

A second mixture for forming an upper porous layer portion was prepared by dispersing 15 parts by weight of carbon black, 65 parts by weight of candelilla wax, 20 parts by weight of polyethylene oxide wax and 35 parts by weight of a copolymer of vinyl chloride and vinyl acetate in 85 parts by weight of a 1:2 (weight basis) mixed solvent of toluene and methyl ethyl ketone.

The second mixture was coated onto the surface of the above-formed lower layer portion, and then dried at 110° C. for 1 minute to form an upper porous layer portion having a thickness of 5 μm.

Thus, thermal image transfer recording medium No. 1 according to the present invention was prepared.

Example 2

A support provided with a heat-resistant protective layer was prepared in the same manner as in Example 1.

A lower layer portion was formed on the support in the same manner as in Example 1.

A second mixture for forming an upper porous layer portion was prepared by dispersing 15 parts by weight of carbon black, 70 parts by weight of candelilla wax, 15 parts by weight of lanolin fatty acid monoglyceride and 100 parts by weight of a copolymer of vinyl chloride and vinyl acetate in 85 parts by weight of a 1:2 (weight basis) mixed solvent of toluene and methyl ethyl ketone.

The second mixture was coated onto the surface of the lower layer portion, and then dried at 110° C. for 1 minute to form an upper layer portion having a thickness of 5 μm.

Thus, thermal image transfer recording medium No. 2 according to the present invention was prepared.

Comparative Example 1

A mixture for forming an ink layer was prepared by dispersing 100 parts by weight of a gelled thermofusible ink which was the same as the one used in Example 1 and 100 parts by weight of a copolymer of vinyl chloride and vinyl acetate in 85 parts by weight of a 1:2 (weight basis) mixed solvent of toluene and methyl ethyl ketone. This mixture was coated onto a support provided with a heat-resistant protective layer prepared in the same manner as in Example 1, and then dried at 110° C. for 1 minute to form a single ink layer having a thickness of 15 μm.

Thus, comparative thermal image transfer recording medium No. 1 was prepared.

Example 3

A support provided with a heat-resistant protective layer was prepared in the same manner as in Example 1.

Onto the other side of the support, a liquid prepared by dissolving 20 wt.% of a vinyl chloride - vinyl acetate copolymer in a 1: 2 (weight basis) mixed solvent of toluene and methyl ethyl ketone was coated, and then dried at a temperature of 80° C. for 30 seconds to form an adhesive layer having a thickness of 0.4 μm.

Preparation of Gelled Thermofusible Ink

Fifteen parts by weight of carbon black, 60 parts by weight of candelilla wax, 23 parts by weight of polyethylene oxide wax and 2 parts by weight of terpene resin (hardening agent) were placed in a sand mill vessel, and dispersed at a temperature of 110° C. to obtain a homogeneous ink dispersion.

The ink dispersion was cooled to a temperature of 65° C., to which were added 10 parts by weight of an oil-soluble dye, benzole black, having a low melting point, and 675 parts by weight of a 1:2 (weight basis) mixed solvent of toluene and methyl ethyl ketone, and then dispersed again at a temperature of 32° C. The resulting dispersion was cooled to room temperature to obtain a gelled thermofusible ink.

Formation of Lower Non-Porous Layer Portion

By using the gelled thermofusible ink, a first mixture for forming a lower non-porous layer portion having the following formulation was prepared.

| | Parts by Weight |
|---|---|
| Gelled thermofusible ink | 10 |
| 1:2 (weight basis) mixed solvent of toluene and methyl ethyl ketone containing 20 wt. % of vinyl chloride/-vinyl acetate copolymer | 3 |
| Azobisisobutyronitrile | 0.1 |

The first mixture was coated onto the adhesive layer formed on the support, and then dried at a temperature of 75° C. for 1 minute, thereby forming a lower layer portion having a thickness of 8 μm.

Formulation of Upper Porous Layer Portion

By using the gelled thermofusible ink, a second mixture for forming an upper porous layer portion having the following formulation was prepared.

| | Parts by Weight |
|---|---|
| Gelled thermofusible ink | 10 |
| 1:2 (weight basis) mixed solvent of toluene and methyl ethyl ketone containing 20 wt. % of vinyl chloride/-vinyl acetate copolymer | 3 |

The second mixture was coated onto the surface of the lower layer portion, and then dried at a temperature of 110° C. for 1 minute, thereby forming an upper porous layer portion having a thickness of 2 μm.

Thus, thermal image transfer recording medium No. 3 according to the present invention was obtained.

This recording medium was subjected to an microscopic observation by using a transmission electron microscope, and a picture of its cross section was taken, which is shown in FIG. 2.

Example 4

A support provided with a heat-resistant protective layer was prepared in the same manner as in Example 1.

A lower layer portion was formed on the support in the same manner as in Example 1, except that the copolymer of vinyl chloride and vinyl acetate used as the resin component of the lower layer portion in Example 1 was replaced by nitrocellulose having a molecular weight of 100,000.

On the surface of the above-formed lower layer portion, an upper porous layer portion was formed in the same manner as in Example 1.

Thus, thermal image transfer recording medium No. 4 according to the present invention was prepared.

Example 5

A support provided with a heat-resistant protective layer was prepared in the same manner as in Example 1.

A lower layer portion was formed on the support in the same manner as in Example 1.

On the surface of the above-formed lower layer portion, an upper porous layer portion was formed in the same manner as in Example 1, except that the copolymer of vinyl chloride and vinyl acetate used as the resin component of the upper layer portion in Example 1 was replaced by nitrocellulose having a molecular weight of 100,000.

Thus, thermal image transfer recording medium No. 5 according to the present invention was prepared.

Each of the above-prepared thermal image transfer recording media Nos. 1 to 5 according to the present invention and comparative thermal image transfer recording medium No. 1 was placed in a line thermal printer, and images were transferred four times to an image receiving sheet from the same portion of the recording medium under the following conditions:

| | |
|---|---|
| Thermal head: | Thin-film head type |
| Platen pressure: | 230 gf/cm |
| Peeling angle against image receiving sheet: | 45° |
| Energy applied from thermal head: | 22 mJ/mm$^2$ |
| Printing speed: | 2 inch/sec |
| Image receiving sheet: | high quality paper having a Beck's smoothness of 320 sec. |

The density of the images obtained by each time of 1st, 2nd, 3rd and 4th printings was measured by a McBeth desitometer RD-914. The results are shown in the table below.

TABLE

| Recording Medium | Density of Images | | | |
|---|---|---|---|---|
| | 1st | 2nd | 3rd | 4th |
| No. 1 | 1.28 | 1.33 | 1.21 | 1.13 |
| No. 2 | 1.41 | 1.38 | 1.35 | 1.26 |
| No. 3 | 1.40 | 1.36 | 1.34 | 1.24 |
| No. 4 | 1.31 | 1.31 | 1.25 | 1.21 |
| No. 5 | 1.26 | 1.21 | 1.20 | 1.20 |
| Comp. No. 1 | 1.45 | 1.26 | 1.02 | 0.88 |

The data shown in the above table clearly demonstrate that the thermal image transfer recording media according to the present invention ca yield images with hardly causing decrease in the image density even when the recording media are used repeatedly.

Furthermore, no exfoliation of the ink layer of each of the recording media was observed. As a result, it was found that the ink layer of each of the recording media Nos. 1 to 5 according to the present invention was not exfoliated even after the 4th printing. On the other hand, the ink layer of the comparative recording medium No. 1 was exfoliated only after the 2nd printing.

What is claimed is:

1. A thermal image transfer recording medium comprising:

(1) a support, and (2) an ink layer formed thereon, consisting essentially of (i) a lower non-porous layer comprising a first thermofusible ink and a first resin, and (ii) an upper porous layer located on top of said lower non-porous layer, comprising a second thermofusible ink and a second resin having a minute porous structure in which said second thermofusible ink is supported, the relative amount of said second resin in said upper porous layer being higher than that of said first resin in said lower non-porous layer, and said second resin and said support being joined by said first resin.

2. The thermal image transfer recording medium as claimed in claim 1, wherein said relative amount of said first resin in said lower non-porous layer is 20 to 40 wt.% of the total weight of said lower non-porous layer, and said relative amount of said second resin in said upper porous layer portion is 30 to 70 wt.% of the total weight of said upper porous layer.

3. The thermal image transfer recording medium as claimed in claim 1, wherein said second resin contained in said upper porous layer is three-dimensionally extended to form a porous structure including a plurality of minute pores with a diameter of 1 to 12 μm.

4. The thermal image transfer recording medium as claimed in claim 1, wherein said first resin contained in said lower non-porous layer and said second resin contained in said upper porous layer are compatible with each other.

5. The thermal image transfer recording medium as claimed in claim 1, wherein said first resin contained in said lower non-porous layer has a glass transition temperature which is higher than the melting point of said first thermofusible ink contained in said lower non-porous layer.

6. The thermal image transfer recording medium as claimed in claim 1, wherein said second resin contained in said upper porous layer has a glass transition temperature which is higher than the melting point of said second thermofusible ink contained in said upper porous layer.

7. The thermal image transfer recording medium as claimed in claim 1, wherein said first resin contained in said lower non-porous layer is selected from the group consisting of a vinyl chloride resin, a copolymer of vinyl chloride and vinyl acetate, a polyester resin, an epoxy resin, a polycarbonate resin, a phenol resin, a polyimide resin, a cellulose resin, a polyamide resin and an acrylic resin.

8. The thermal image transfer recording medium as claimed in claim 1, wherein said second resin contained in said upper porous layer is selected from the group consisting of a vinyl chloride resin, a copolymer of vinyl chloride and vinyl acetate, a polyester resin, an epoxy resin, a polycarbonate resin, a phenol resin, a polyimide resin, a cellulose resin, a polyamide resin and an acrylic resin.

9. The thermal image transfer recording medium as claimed in claim 1 wherein said first thermofusible ink contained in said lower non-porous layer and said second thermofusible ink contained in said upper porous layer are compatible with each other.

10. The thermal image transfer recording medium as claimed in claim 1, wherein said second thermofusible ink is gelled when mixed with said second resin, or is non-compatible with said second resin.

11. The thermal image transfer recording medium as claimed in claim 1, wherein said first thermofusible ink contained in said lower non-porous layer comprises a coloring agent and a vehicle.

12. The thermal image transfer recording medium as claimed in claim 11, wherein said coloring agent is selected from the group consisting of carbon black, phthalocyanine pigments, direct dyes, acidic dyes, basic dyes, dispersible dyes and oil-soluble dyes.

13. The thermal image transfer recording medium as claimed in claim 11, wherein said vehicle is selected from the group consisting of beeswax, carnauba wax, whale wax, Japan wax, candelilla wax, rice bran wax, montan wax, paraffin wax, microcrystalline wax, oxidized wax, ozocerite, ceresine wax, ester wax, margaric acid, lauric acid, myristic acid, palmitic acid, stearic acid, fromic acid, behenic acid, stearyl alcohol, behenyl alcohol, sorbitan fatty acid ester, stearic amide and oleic amide.

14. The thermal image transfer recording medium as claimed in claim 1, wherein said second thermofusible ink contained in said upper porous layer comprises a coloring agent and a vehicle.

15. The thermal image transfer recording medium as claimed in claim 14, wherein said coloring agent is selected from the group consisting of carbon black, phthalocyanine pigments, direct dyes, acidic dyes, basic dyes, dispersible dyes and oil-soluble dyes.

16. The thermal image transfer recording medium as claimed in claim 14, wherein said vehicle is selected from the group consisting of beeswax, carnauba wax, whale wax, Japan wax, candelilla wax, rice bran wax, montan wax, paraffin wax, microcrystalline wax, oxidized wax, ozocerite, ceresine wax, ester wax, margaric acid, lauric acid, myristic acid, palmitic acid, stearic acid, fromic acid, behenic acid, stearyl alcohol, behenyl alcohol, sorbitan fatty acid ester, stearic amide and oleic amide.

17. The thermal image transfer recording medium as claimed in claim 1, wherein said lower non-porous layer has a thickness of 3 to 15 μm.

18. The thermal image transfer recording medium as claimed in claim 1, wherein said upper porous layer has a thickness of 1 to 5 μm.

19. The thermal image transfer recording medium as claimed in claim 1, wherein said support is made from a material selected from the group consisting of polyester, polycarbonate, triacetyl cellulose, nylon, polyimide, cellophane, parchment paper and condenser paper.

20. The thermal image transfer recording medium as claimed in claim 1, wherein said support has a thickness of 2 to 15 μm.

21. The thermal image transfer recording medium as claimed in claim 1, further comprising a heat-resistant protective layer formed on the back surface of said support.

22. The thermal image transfer recording medium as claimed in claim 21, wherein said heat-resistant protective layer is made from a material selected from the group consisting of a silicone resin, a fluorine-containing resin, a polyimide resin, an epoxy resin, a phenol resin, a melamine resin and nitrocellulose.

23. The thermal image transfer recording medium as claimed in claim 1, further comprising an adhesive layer interposed between said support and said ink layer.

24. The thermal image transfer recording medium as claimed in claim 23, wherein said adhesive layer is made from a material selected from the group consisting of a copolymer of ethylene and vinyl acetate, a copolymer of vinyl chloride and vinyl acetate, a copolymer of ethylene and acrylate, polyethylene, polyamide, polyester, a petroleum resin and nylon.

25. The thermal image transfer recording medium as claimed in claim 23, wherein said adhesive layer has a thickness of 0.2 to 2.0 μm.

* * * * *

UNITED STATES PATENT AND TRADEMARK OFFICE

CERTIFICATE OF CORRECTION

PATENT NO. : 5,134,019

DATED : July 28, 1992

INVENTOR(S) : Keiichi Shiokawa et al

It is certified that error appears in the above-identified patent and that said Letters Patent is hereby corrected as shown below:

Col. 1, line 59, delete "[3)" and insert --(3)--.

Col. 6, line 66, change "candelllla" to -- candelilla--.

Col. 9, line 64, delete "ca", and insert --can--.

Col. 6, line 1, delete "thermosufible", and insert --thermofusible--.

Signed and Sealed this

Fifth Day of October, 1993

*Attest:*

Bruce Lehman

BRUCE LEHMAN

*Attesting Officer*

*Commissioner of Patents and Trademarks*